US008448296B2

(12) United States Patent
Kellum, III

(10) Patent No.: US 8,448,296 B2
(45) Date of Patent: May 28, 2013

(54) SIDE LOAD CARRIER AND BALANCE SYSTEM FOR WINDOW SASHES

(75) Inventor: Wilbur James Kellum, III, Hilton, NY (US)

(73) Assignee: Caldwell Manufacturing Company North America, LLC, Rochester, NY (US)

( * ) Notice: Subject to any disclaimer, the term of this patent is extended or adjusted under 35 U.S.C. 154(b) by 0 days.

(21) Appl. No.: 13/273,700

(22) Filed: Oct. 14, 2011

(65) Prior Publication Data

US 2012/0030903 A1 Feb. 9, 2012

Related U.S. Application Data

(63) Continuation of application No. 12/907,132, filed on Oct. 19, 2010, which is a continuation-in-part of application No. 12/568,314, filed on Sep. 28, 2009, now abandoned.

(60) Provisional application No. 61/101,694, filed on Oct. 1, 2008.

(51) Int. Cl.
*E05D 13/00* (2006.01)

(52) U.S. Cl.
USPC ..... 16/193

(58) Field of Classification Search
USPC ..... 16/193, 200, 199, 194, 197; 49/445–446, 49/181, 421
See application file for complete search history.

(56) References Cited

U.S. PATENT DOCUMENTS

| | | | | | |
|---|---|---|---|---|---|
| 2,796,630 | A | | 6/1957 | Haas | |
| 2,987,758 | A | | 6/1961 | Osten, Sr. | |
| 3,012,292 | A | * | 12/1961 | Brengman | 49/446 |
| 3,280,511 | A | | 10/1966 | Johnson | |
| 3,501,867 | A | * | 3/1970 | Scott | 49/421 |
| 3,788,006 | A | * | 1/1974 | Teggelaar et al. | 49/417 |
| 4,571,887 | A | * | 2/1986 | Haltof | 49/429 |
| 4,763,447 | A | * | 8/1988 | Haltof et al. | 49/429 |
| 4,885,871 | A | | 12/1989 | Westfall et al. | |
| 5,099,963 | A | | 3/1992 | Alchin | |
| 5,873,199 | A | | 2/1999 | Meunier et al. | |
| 6,041,475 | A | | 3/2000 | Nidelkoff | |
| 6,892,494 | B2 | | 5/2005 | Malek | |
| 6,948,279 | B1 | | 9/2005 | Newton et al. | |
| 7,013,529 | B2 | | 3/2006 | Pettit et al. | |
| 7,367,162 | B2 | | 5/2008 | Lucci | |
| 7,966,770 | B1 | | 6/2011 | Kunz | |
| 2004/0065016 | A1 | * | 4/2004 | Malek | 49/181 |
| 2005/0166461 | A1 | * | 8/2005 | Lucci | 49/446 |

* cited by examiner

*Primary Examiner* — Victor Batson
*Assistant Examiner* — Matthew Sullivan
(74) *Attorney, Agent, or Firm* — Harness, Dickey & Pierce, P.L.C.

(57) ABSTRACT

A carrier assembly can be used to couple a balance assembly with a window sash. The carrier assembly can engage the window sash to transfer a force from the balance assembly to balance a weight of the window sash. The carrier assembly, due to interactions of the window sash with the carrier assembly and the balance assembly with the carrier assembly, can tightly engage the window sash, either directly or through a bracket, to substantially eliminate unselected movement or forces applied from the balance assembly.

25 Claims, 12 Drawing Sheets

SIDE LOAD CARRIER AND BALANCE SYSTEM FOR WINDOW SASHES

CROSS-REFERENCE TO RELATED APPLICATIONS

This application is a continuation of U.S. patent application Ser. No. 12/907,132 filed on Oct. 19, 2010; which is a continuation-in-part of U.S. patent application Ser. No. 12/568,314 filed on Sep. 28, 2009; which claims the benefit of U.S. Provisional Application No. 61/101,694, filed on Oct. 1, 2008. The entire disclosure for the above applications are incorporated herein by reference.

FIELD

The present disclosure relates to a window assembly, and particularly to a carrier assembly to connect to a window sash.

BACKGROUND

This section provides background information related to the present disclosure which is not necessarily prior art.

A hung window assembly comprises a window sash that moves within a window frame. The window frame guides the window sash as it moves between an OPENED and CLOSED position (i.e., an up and down movement of the sash). In order to counter the weight of the window sash, and provide for smooth operation of the window assembly to a user both in an upward and in a downward manner, a balance assembly is incorporated in the hung window assembly. Generally, the balance assembly is mounted to the frame of the window system, such as within the jamb channel. The window sash engages a carrier which is connected to the balance assembly. Accordingly, the balance assembly is interconnected with the window sash through the carrier.

Balance assemblies that counter the weight of the window sash can take the form of various generally known mechanisms, including a block-and-tackle balance assembly, a spiral balance assembly, and a hybrid balance assembly. In a block-and-tackle assembly a pulley system can operate with a spring to overcome the force of gravity on the window sash. In a spiral or hybrid balance assembly, a torsion spring can be employed to assist in overcoming the force of gravity on the window sash.

These known balance assemblies, however, can also generate other forces and/or force components in addition to those that counter the weight of the window sash. These forces and/or force components can include lever forces, moments, and/or torques that tend to urge or bind the carrier against the jamb channel thereby creating friction forces between the carrier and the jamb channel during movement of the window sash. To operate the window sash, then, these additional frictional forces must also be overcome by the user. As a result, the consistent and smooth operation of the window assembly can be compromised.

SUMMARY

This section provides a general summary of the disclosure, and is not a comprehensive disclosure of its full scope or all of its features.

A system and method is disclosed that allows and provides a window sash carrier that is operable to removeably contact and engage a window sash during operation. The sash carrier can generally interconnect with a window sash in a manner allowing for substantially conventional positioning of a window sash within a window frame or jamb, such as via side-loading, and substantially conventional removal from the window jamb. The carrier, however, can operably contact and engage the window sash during operation of a window balance.

The carrier can be positioned against a window sash, such as directly against a frame of a window sash or can be connected against or positioned against a sash bracket. The carrier and the sash bracket can both have contacting surfaces that can engage one another. The contacting surfaces of the carrier and the sash bracket can resist or counter the lever forces, moments and/or torques that may be generated by the balance assemblies. For example, the carrier can engage the sash bracket in a manner that does not allow the carrier to rotate relative to the sash bracket. Thus, due to the contact surfaces, a carrier would generally not bind against the jamb channel or jamb channel wall. Because the carrier does not bind against the jamb channel additional friction forces between the carrier and the jamb channel are eliminated or reduced. Thus, the force required to move the window sash would generally only be the weight of the window sash, the friction forces between the window sash frame and the jamb channel and the friction forces within the balance. Additional undesired forces would not be caused by movement of the carrier due to forces applied by the balance assembly to the carrier. Accordingly, a carrier and window sash engagement can be used to eliminate or reduce undesired interactions of the carrier and the jamb channel.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
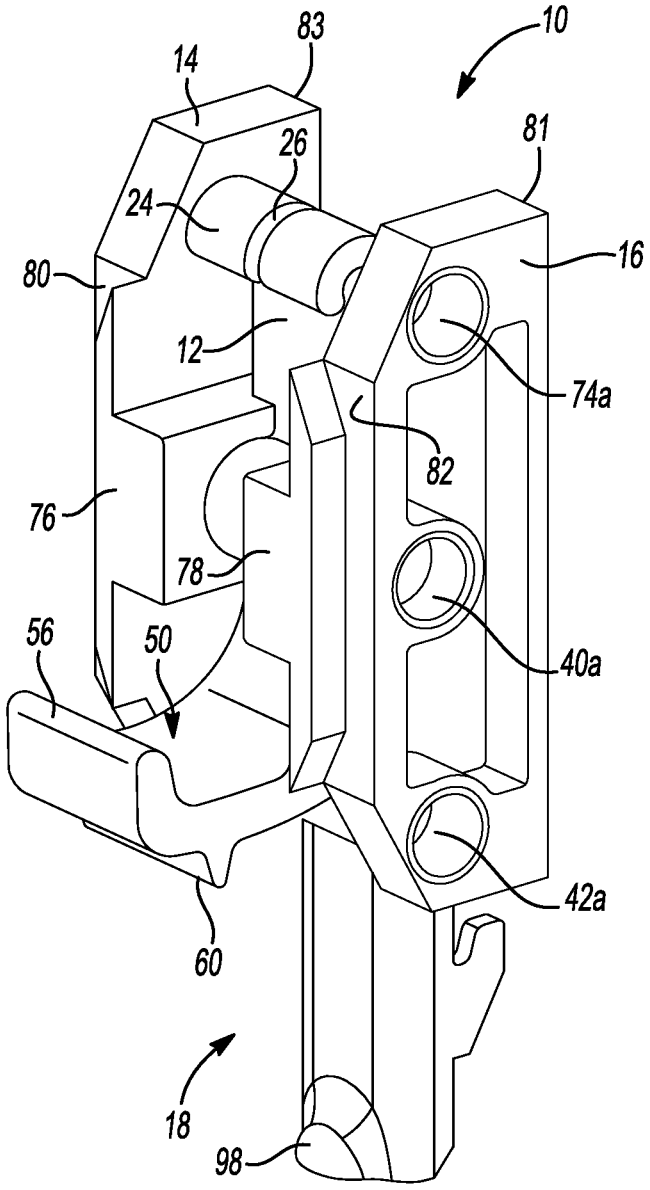
FIG. 1 is a perspective assembled view of a carrier assembly, according to an embodiment of the disclosure.
Figure 2:
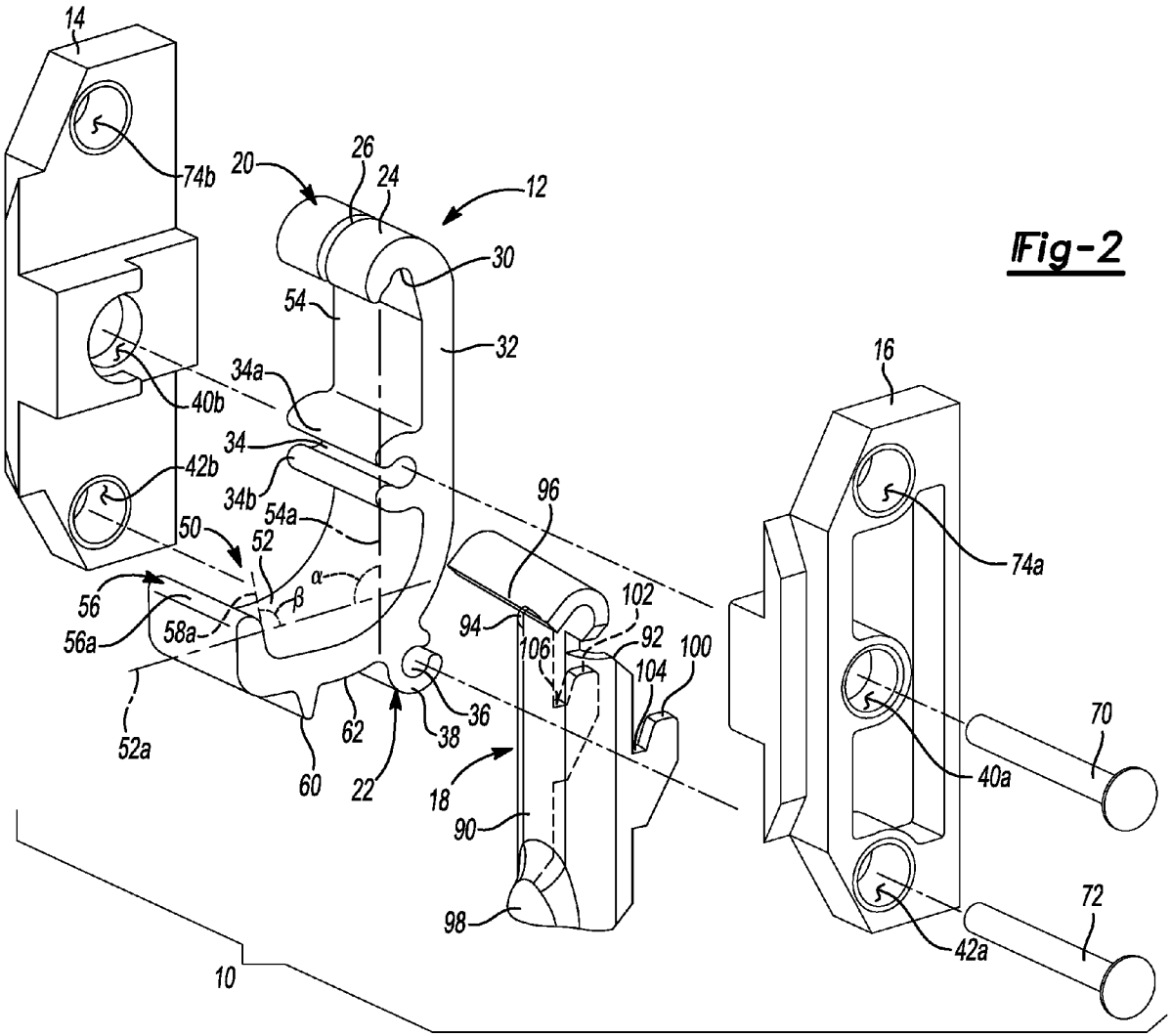
FIG. 2 is an exploded perspective view of the carrier assembly of FIG. 1.

A carrier assembly 10 according to an embodiment of the disclosure is illustrated assembled in FIG. 1 and exploded in FIG. 2. The carrier assembly 10 can include a carrier member or element 12, a first encasement member 14, and a second encasement member 16. The two encasement members 14, 16 can be substantially mirror copies of each other, according to various embodiments, and be mounted to the carrier member 12, as discussed further herein. Additionally, a carrier latch member 18 can also be interconnected with the carrier member 12. The carrier member 12 can be coupled with a window sash according to various embodiments, as discussed further herein. The latch member 18 can be used to engage, at selected times, the window sash and a jamb channel or other portion of the window frame to fix the carrier member 12 at a selected location relative to the window frame.

The carrier assembly 10, according to various embodiments, is understood to be an assembly that can interconnect a window balance with a window sash, as illustrated herein. Generally, the interconnection of the window balance with the window sash is reversible, and can generally be reversible at both an attachment of the window balance to the carrier assembly and the window sash to the carrier assembly 10. Accordingly, the carrier assembly 10 can be assembled into a window and disassembled from a window installation, removal, and repair. As will be discussed herein, the carrier assembly 10, therefore, includes portions that can both engage directly and/or indirectly a window sash and engage directly and/or indirectly a window balance. In this manner, forces can be applied to the carrier assembly 10, advantageously, as further discussed herein.

According to various embodiments, the carrier assembly 10 can engage a window sash due to forces applied to the carrier assembly 10, such as through the carrier member 12. By engaging the window sash, a separate carrier channel within a jamb channel of the window may not be necessary. Generally, a carrier channel can be provided to tightly guide the carrier assembly 10 via carrier channel walls. However, if the carrier assembly 10 is held at a single location relative to a window sash, the window sash can be fitted and moved within the jamb channel without need of a separate carrier channel. Accordingly, a carrier channel can be eliminated or its carrier channel walls be substantially reduced in size (e.g. thickness) as the walls would not be required to resist a force being applied by the carrier assembly 10 that is transferred by or from the balance assembly. Accordingly, a window assembly can be provided in a more cost effective manner as being formed of less material in fewer production steps, as well as other considerations. As the weight of the window sash increases, the counter force required to be generated by a window balance in order for the window sash to be moved substantially or perceptively effortlessly, also increases. For example, a window sash that weighs about ten pounds may need a combined balance counter force of about 8 to 10 pounds while the window sash that weighs 20 pounds may need a combined balance of about 18-20 pounds. But, as the balance force increases so do the reaction forces applied to the carrier assembly 10 by the balance assembly that negatively impact the selected operation of the window, such as torsion and fulcrum forces as discussed herein. Accordingly, the carrier assembly 10 can include portions that allow it to engage the window sash, as discussed herein.

Refocusing again to FIGS. 1 and 2, the carrier member 12 can be formed of a metal or metal alloy while the encasement members 14, 16 can be formed of polymers or other materials that are different from the carrier member 12. It will be understood, however, that the carrier member 12, the encasement members 14, 16, and the latch member 18 can all be formed of the same material. Additionally, it will be understood that the encasement members 14, 16, the carrier member 12, and the latch member 18 need not all be required in the carrier assembly 10. For example, the latch member 18 can be eliminated from the carrier assembly 10 according to various embodiments, as can at least one of the encasement members 14, 16. Nevertheless, according to the embodiment illustrated in FIG. 2, the carrier member 12 can be formed and assembled with two encasement members 14, 16.

Figure 7:
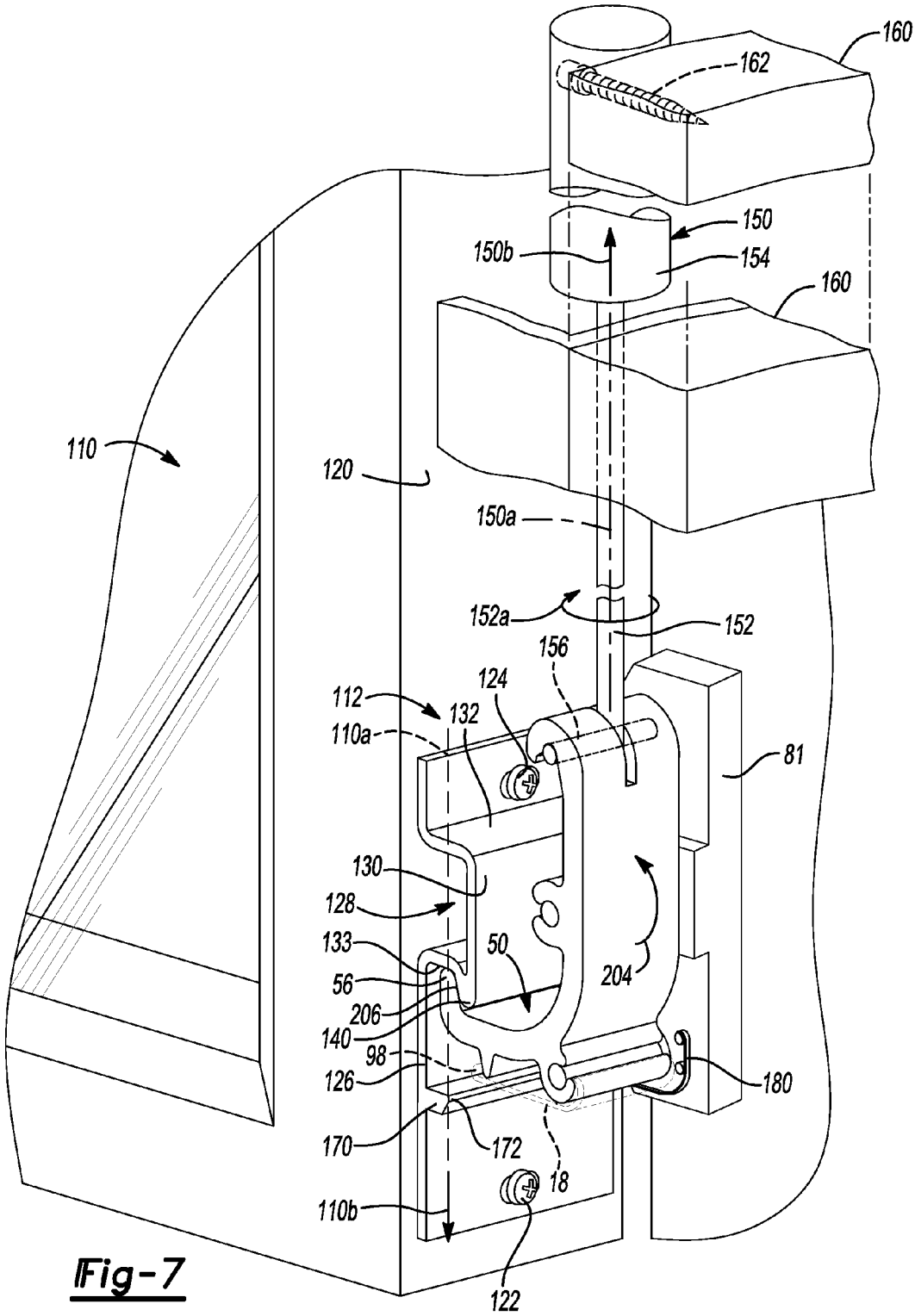
FIG. 7 is an environmental assembled view of the carrier assembly of FIG. 1.

The carrier member 12 can generally extend from near a first end 20 to a second end 22. Near the first end 20 can be defined a hook segment or segments 24 separated by at least one slot 26. It will be understood, however, that more than one slot 26 can be provided in the hook segment 24 such that more than two of the hook segments 24 are formed. For example, two slots 26 can be provided such that there are three hook members or portions 24. The slot 26, as discussed further herein, can be used to position a portion of the balance member (e.g. a balance rod 152 as illustrated in FIG. 7) relative to the carrier member 12. The balance assembly can include a pin or engagement member (e.g. member 156 in FIG. 7) that engages a hook receiving portion 30 of the hook segments 24. The hook engagement portion 30 is generally defined between the first end 20 and the second end 22 and such that a force provided by an external member away from the second end 22 (e.g. the window sash and/or the balance) pushes against and towards the hook segments 24.

The carrier member 12 includes a first wall member 32 that extends generally between the first end 20 and the second end 22. Extending from a first side of the wall 32 are the hook portions 24 and a fastener receptacle, also referred to as a middle fastener receptacle 34, which is defined by or between a first fastener wall **34*a* and a second fastener wall 34*b*. The fastener receptacle 34 can be defined generally on the same side of the wall 32 as the hook segments 24. A second fastener receptacle 36 can be defined by a receptacle wall 38 that is at least partially annular in cross-section. The second receptacle 36 can be positioned on an opposite side of the wall 32 from the first receptacle 34**.

The receptacles 34, 36 can allow for engagement of fastener members 72, 70 to fasten the encasement members 14, 16 to the carrier member 12, as illustrated in FIG. 1. The encasement members 14, 16 can include first through holes

40*a* and 40*b* respectively and second through holes 42*a* and 42*b*. The through holes 40*a*, 40*b* and 42*a*, 42*b* allow for passage of the fasteners 72, 70 through the respective holes 40*a*, 40*b* and 42*a*, 42*b* and through the respective fastener receptacles 34, 36 to fasten the encasement members 14, 16 to the carrier member 12.

Figure 5:
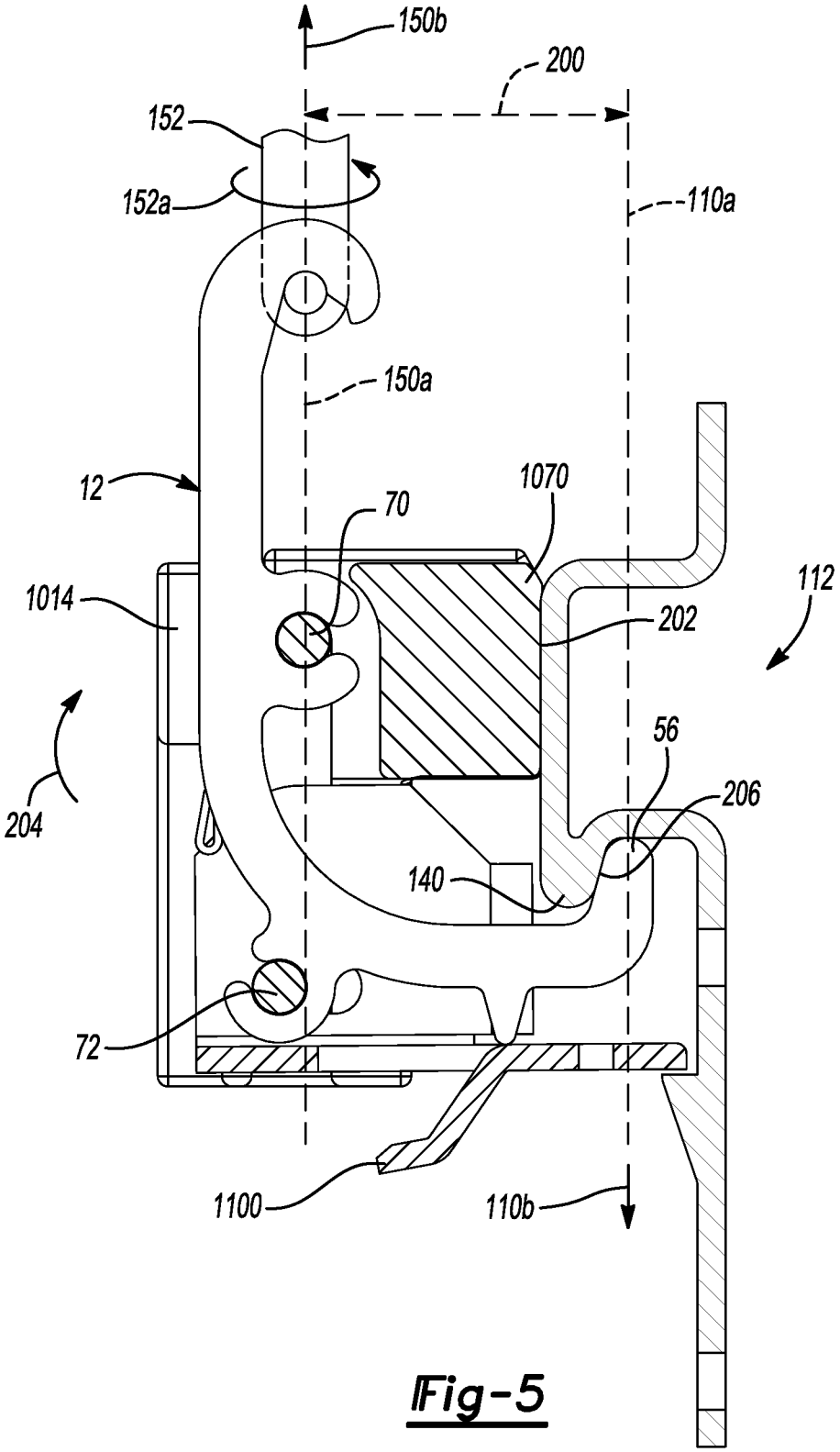
FIG. 5 is a partial cross-sectional front view of the carrier assembly illustrated in FIG. 3.

The carrier member 12 can further include a platform 50 that can be substantially horizontal or extend transverse to the wall 32. The platform 50, as illustrated in FIG. 5, can carry a window sash directly or with a sash bracket 112, thus the weight of the window sash is generally held on the platform 50 of the carrier member 12. The platform 50 can include a wall or surface 52 that extends substantially transverse to a surface 54 of the wall 32. As illustrated in FIG. 2, the surface 52 of the platform 50 can extend generally along an axis 52*a* while the surface 54 of the wall 32 can generally extend along an axis 54*a*. The two axes 52*a*, 54*a* can be generally transverse relative to one another and define an internal angle $\alpha$. The platform 50 can terminate in a projection 56 that further includes a surface 58 that can extend along an axis 58*a* that is formed at an angle relative to the axis 52*a* of the surface 52. The axis 52*a* and 58*a* can define internal angle $\beta$ therebetween. Additionally, a leg or projection 60 can extend from the platform 50 from a surface 62 that is substantially opposite the surface 52 of the platform 50. Accordingly, the projection or leg 60 generally extends away from or in a direction opposite to the projection 56. Additionally, the projection 56 extends generally from the surface 52 of the platform 50 to an upper edge 56*a* such that an area is defined between the ledge surface 58 and a portion of the wall 32 of the carrier member 12.

The encasement members 14, 16 can be fixed to the carrier member 12 with the one or more fasteners 70 and 72. The fasteners 70 can go through the passage 42*a*, receptacle 36, and passage 42*b*, and the fastener 72 can go through the passage 40*a*, receptacle 34*a*, and passage 40*b*. The fasteners 70, 72 can be any appropriate fasteners such as a threaded screw, threaded bolt with a nut operable to engage the bolt threads on an opposing side, rivets, or other appropriate attachment mechanisms (e.g. a snap-fit portion of each of the members). The fasteners 70, 72 allow for a mechanical and fixed interconnection of the encasement members 14, 16 with the carrier member 12. As discussed further herein, the carrier member 12 engages a balance, such as with the hook portions 24 and a window sash on the platform 50. Accordingly, mechanical forces resulting from the interaction of the balance with the window sash can generate forces on the carrier member 12. Due to the fastener 70, 72, the forces that act on the carrier member 12, can be transferred to the encasement members 14, 16.

Figure 3:
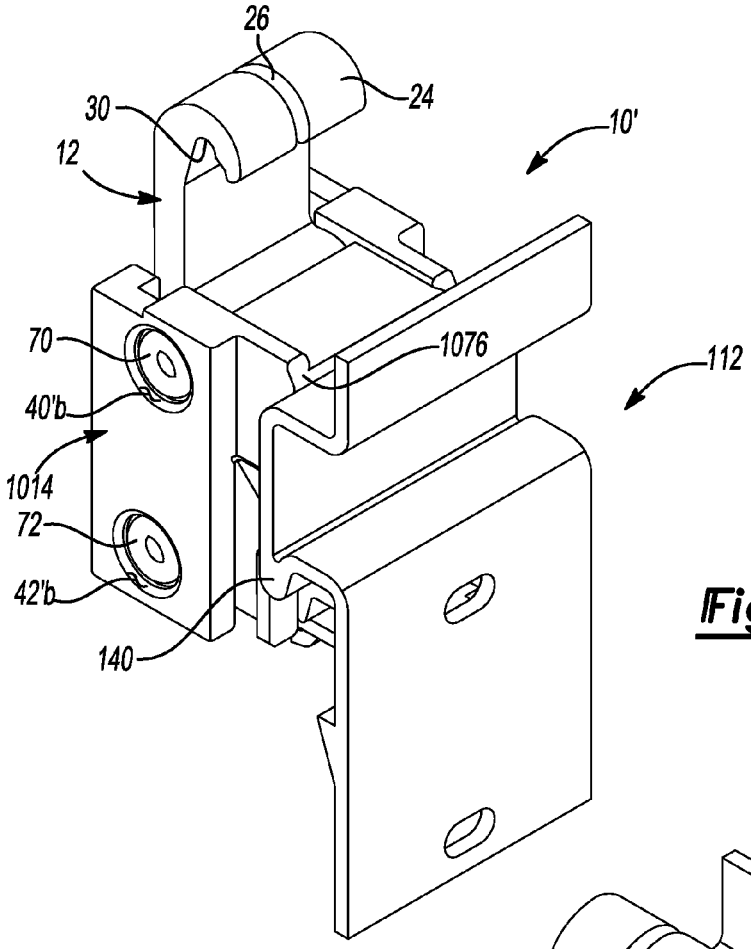
FIG. 3 is a first perspective view of a carrier assembly, according to another embodiment of the disclosure.
Figure 4:
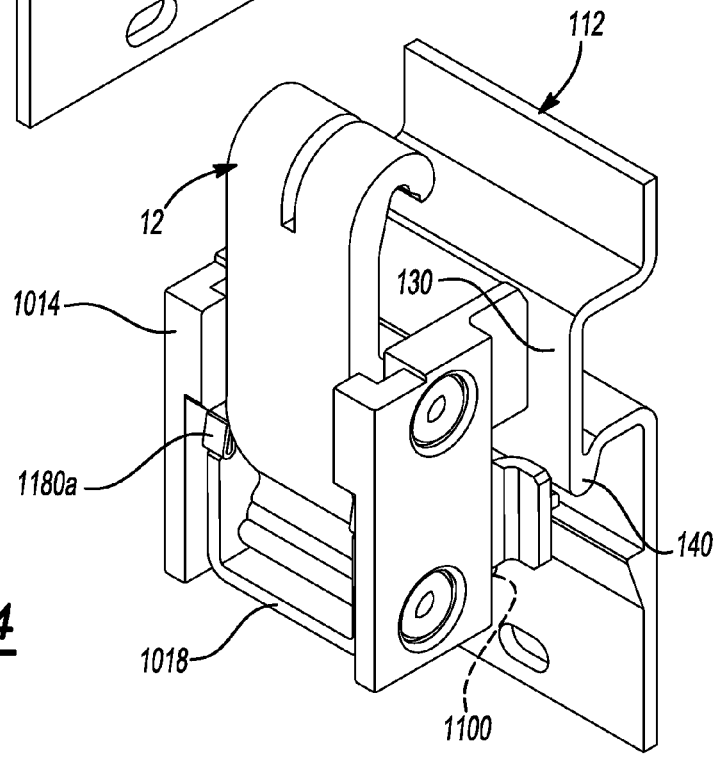
FIG. 4 is a second perspective view of the carrier assembly of FIG. 3.

The encasement members 14, 16 can each optionally further include an upper passage 74*a*, 74*b* which may generally be positioned above and/or lateral to the hook segments 24 to allow passage of an additional fastener. According to various embodiments, as illustrated in FIGS. 3-6, the encasement member(s) need not extend substantially the entire length of the carrier member 12. As illustrated in FIGS. 1 and 2, the encasement members 14, 16 can be substantially mirror images of one another so that a single design, such as a mold design, can be used to make both encasement members 14, 16 that are substantially identical. Two of the single pieces for the encasement members can be rotated relative to one another to act as right and left encasement members to engage the carrier member 12 without requiring an additional and separately designed and molded piece. It will be understood that the encasement members 14, 16 could be alternatively designed as completely unique members that include less than three passages to engage the carrier member 12 (e.g. as illustrated in FIG. 3). For example, the encasement members 14, 16 may include only the passages 40 and 42. If the encasement members include only two passages each, the encasement members may be large enough to define the two passages.

The encasement members 14, 16 can include respective shoulders 76 and 78 defined by or extending from an edge 80, 82. The shoulders 76, 78 can be formed with or extend from the surfaces 80, 82, or the shoulders 76, 78 can be defined by the surfaces 80, 82 of the edges of the encasement members 14, 16. It will be understood, however, that the shoulders 76, 78 can be defined by any portion of the encasement members 14, 16 that extend further toward the projection 56. The shoulders 76, 78 can engage in a portion of a window sash or a connection to a window sash to transfer forces from the carrier member 12 through the encasement members 14, 16 and to the window sash. Accordingly, the portions of the encasement members 14, 16 that extend further toward the projection 56 can function as the shoulders 76, 78. It will also be understood that in alternative embodiments the edges 80, 82 themselves can contact and engage the sash or sash bracket, as discussed herein, and it is unnecessary to include, in addition, the shoulders 76, 78.

The encasement members 14, 16 can also provide sliding bearing surfaces 81, 83 (opposite the edges 80 and 82) to assist in locating the window sash horizontally within the window frame. The bearing surfaces of the encasement members 14, 16 can closely fit to a jamb wall 160 (FIGS. 9-11) of the window jamb channel. Thus, the shoulders 76, 78 can engage the window sash, directly or through a sash bracket, and a bearing surface opposite the shoulders 76, 78 can engage the jamb wall 160 to locate the window sash within the window frame.

Generally, the shoulders 76, 78 can include a surface that is substantially planar and extends at least a portion of the length between the first end 20 and the second end 22 of the carrier member 12. The shoulders 76, 78 can include surfaces or lengths that are substantially parallel with the axis 54*a* of the carrier member 12. However, it will be understood that the surfaces of the shoulders 76, 78 can also be formed at an angle relative to the axis 54*a* of the carrier member 12 to assist in an appropriate engagement of a window sash.

The sash latch 18 can include a generally elongated body 90 with two walls 92 and 94 extending generally perpendicular to one another and transverse to a long axis of the body 90. The latch body 18 can also include a latch hook portion 96. In addition, a finger grip or tool grip 98 can extend from the body or be formed in the body 90 generally at an end of the latch member 18 opposite the hook portion 96. Additionally, jamb protrusions 100 and 102 can extend from the respective walls 92, 94 and each define a depression by a bottom wall 104, 106 between the projections 100 and 102 and a surface of the walls 92, 94.

The protrusions 100, 102 of the latch member 18 can engage slots, depressions, or other portions of the jamb channel to fix the latch member 18 to the jamb channel. The latch member 18 is fixed to the carrier member 12 by the hook portion 96 which can engage a portion of the fastener 72 near the second receptacle 36. The hook portion 96 need not be a continuous member, as illustrated in FIG. 2, but can include multiple portions extending from the member 18 to engage the fastener 72. Additionally, a plurality of the latch members 18 can be provided to engage different portions of the fastener 72 separately. It will be further understood that the latch member 18 need not engage the fastener 72, but can engage other portions of the carrier member 12 or the encasement members 14, 16.

The grip portion 98 can assist a user in manipulating the latch member 18 relative to the carrier member 10. The grip portion 98 can assist in operating the latch member 18, such as for engagement or disengagement from the sash member or the window jamb portions (e.g. when attempting to interconnect the carrier assembly 10 with the jamb portions or the window sash). As illustrated in FIG. 2, the grip portion 98 can generally include a projection that extends from the body 90 to allow or form a portion to be gripped by the finger of the user.

With reference to FIGS. 3-6, a carrier assembly 10' is illustrated. The carrier assembly 10' can be similar to the carrier assembly 10 illustrated in FIGS. 1-2 and discussed above. The carrier assembly 10', therefore, will be referenced and described using reference numerals that are identical to those used above when referencing identical portions. Similar portions will be referenced with the same reference numeral used above augmented with a prime or augmented with a prefix "10". Generally, the carrier assembly 10' is similar to the carrier assembly 10, discussed above, but does not include the encasement members 14, 16 that include the optional upper passages 74*a*, 74*b*. As discussed above, the upper passages 74*a*, 74*b* are optional and need not be provided.

Figure 6:
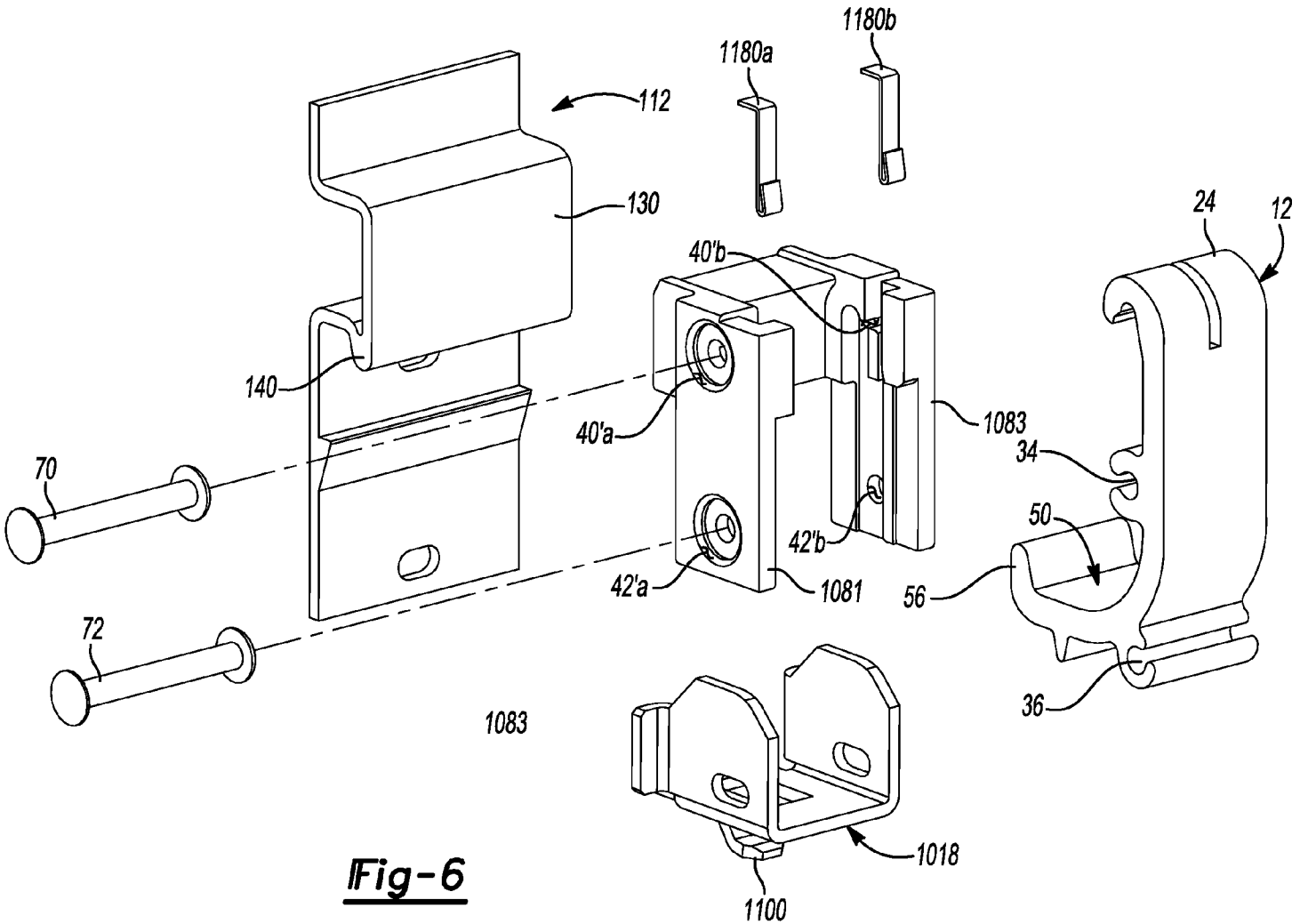
FIG. 6 is an exploded perspective view of the carrier assembly illustrated in FIG. 3.

The carrier assembly 10' can include an encasement member 1014 that can be formed as a single member, as illustrated in FIG. 6, to encase or at least partially surround the carrier member 12. The carrier member 12 included with the carrier assembly 10' can be substantially identical to the carrier member 12 discussed above. Accordingly, the carrier member 12 can include hook members 24, passages 34 and 36, and the platform surface 50. The carrier member 12, therefore, can be interconnected with the encasement member 1014 substantially similar as attaching the encasement members 14, 16 to the carrier member 12, as discussed above.

The encasement member 1014 can be formed as a single member, however, to engage the carrier member 12. Accordingly, the encasement member 1014 can include a single piece shoulder 1076. The shoulder 1076 can contact the sash bracket 112 similar to the shoulders 76, 78 contacting the sash bracket 112 as discussed above and herein. In particular, the shoulder 1076 can contact the carrier engagement portion 130 substantially directly. The encasement member 1014 can also define sliding bearing surfaces 1081, 1083 similar to the sliding bearing surfaces 81, 83 to horizontally locate the window sash.

The carrier member 12 can be interconnected with the encasement member 1014 using the fasteners 70, 72 similar to the interconnection of the encasement members 14, 16 to the carrier member 12 discussed above. Generally, the fasteners 70, 72 can be passed through the passages or holes 40'*a*, 40'*b* and holes 42'*a*, 42'*b* and through the respective passages 34, 36 defined by the carrier member 12.

Figure 8:
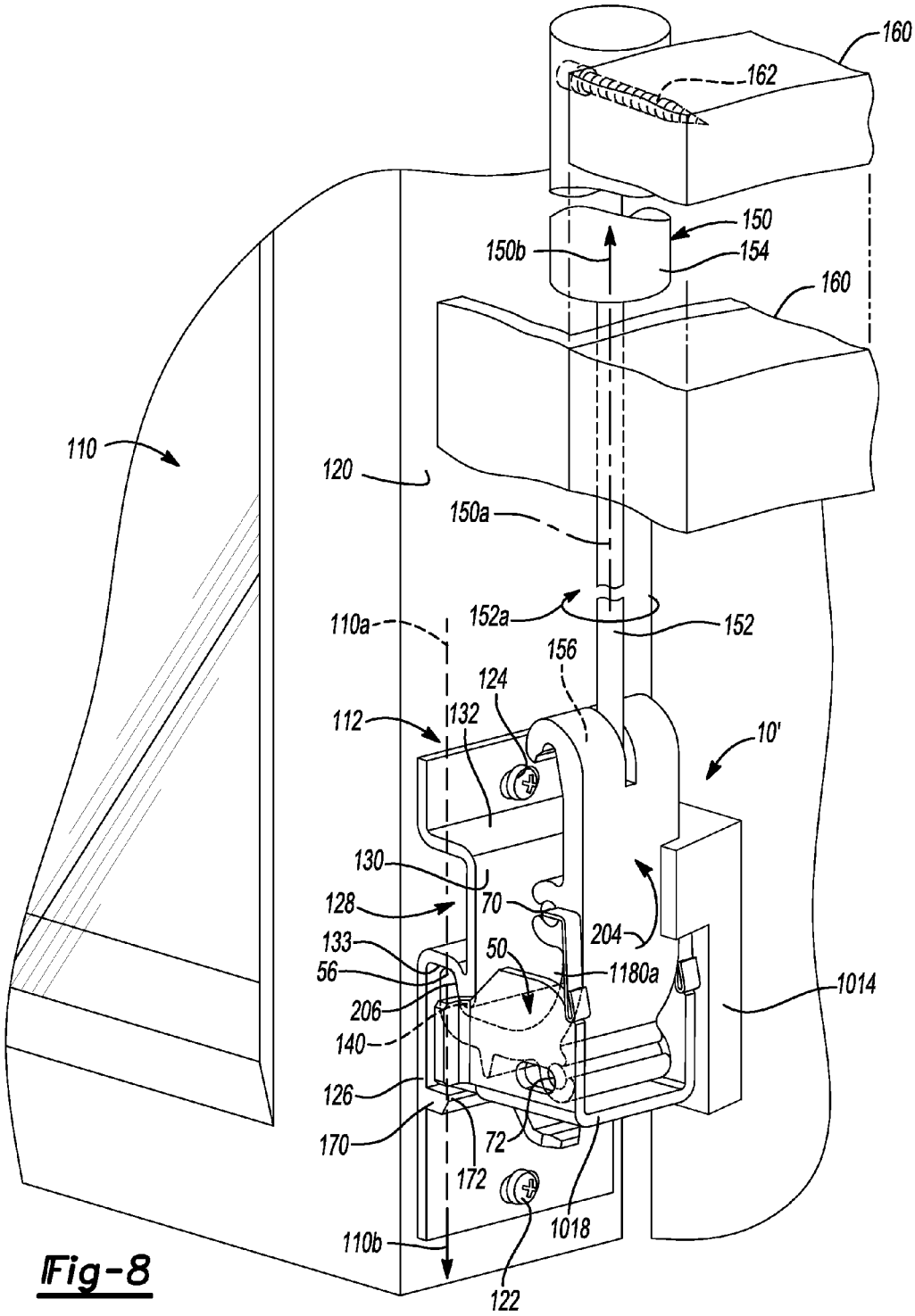
FIG. 8 is an environmental assembled view of the carrier assembly of FIG. 3.
Figure 9:
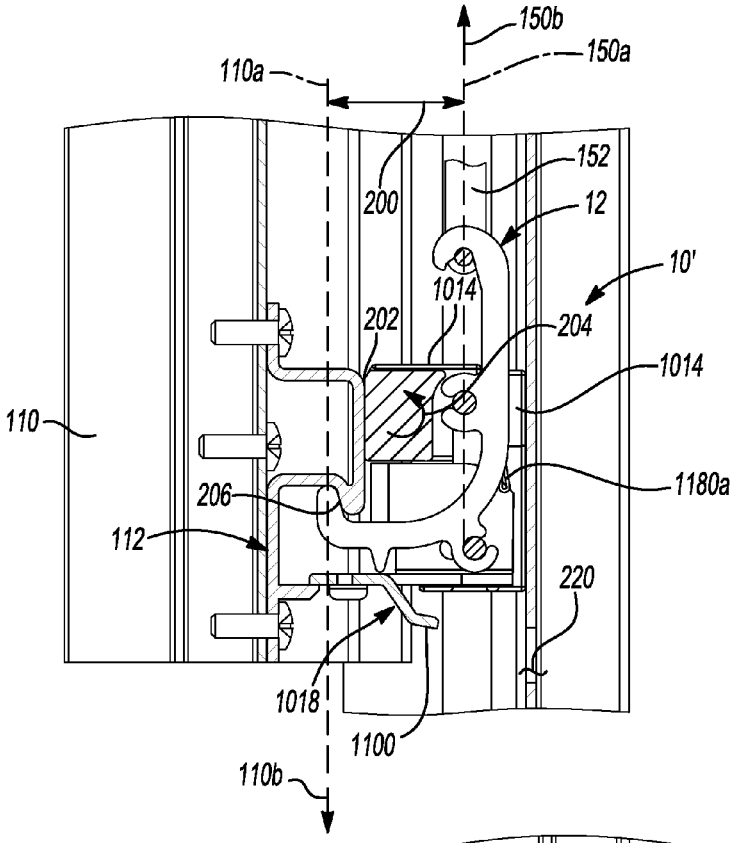
FIG. 9 is a partial cross-sectional front view of the environmental assembled view of FIG. 8 with a latch member in an unlocked position.
Figure 10:
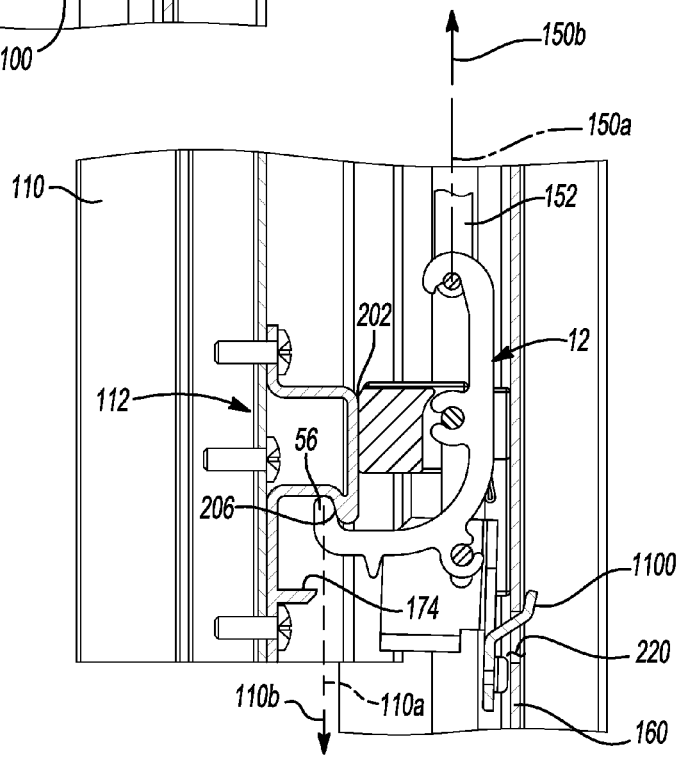
FIG. 10 is a partial cross-sectional front view of the environmental assembled view of FIG. 8 with the latch member in a locked position.

The carrier assembly 10' can further include a latch member 1018 similar to the latch member 18 discussed above. As discussed above, and further herein, the latch member 1018 can connect with a jamb portion of a window assembly to assist in holding the carrier assembly 10' in a selected position relative to the jamb after a balance is connected to the carrier member 12. The latch member 1018 can be moved from a closed position, as illustrated in FIGS. 8 and 9, where the latch member 1018 engages the sash bracket 112, to an engaged or locked position as illustrated in FIG. 10, wherein the latch member engages a passage 220 in the jamb wall 160. Further, the carrier assembly 10' can include biasing springs 1180*a* and 1180*b* to bias the latch member 1018 in the undeployed position, as illustrated in FIG. 9, which is the position that positions the latch member 1018 near the window sash and free of the jamb. Further, the latch member 1018 can include a protrusion 1100 that can engage an appropriate opening or passage in the jamb, as discussed above, to hold the carrier assembly 10' for installation or removal of a window sash, as further discussed herein.

Accordingly, it is understood that the carrier assembly 10' can be similar to the carrier assembly 10 discussed above. The carrier member 12 can be substantially identical and encased or positioned within the encasement member 1014 that can be formed as a single piece rather than two pieces that are interconnected to engage the carrier member 12. Nevertheless, the encasement member 1014 can include the shoulder 1076 that is similar to the surfaces 80, 82 or shoulders 76, 78 discussed above, but defined by the single encasement member 1014 rather than two encasement members 14, 16.

Figure 11:
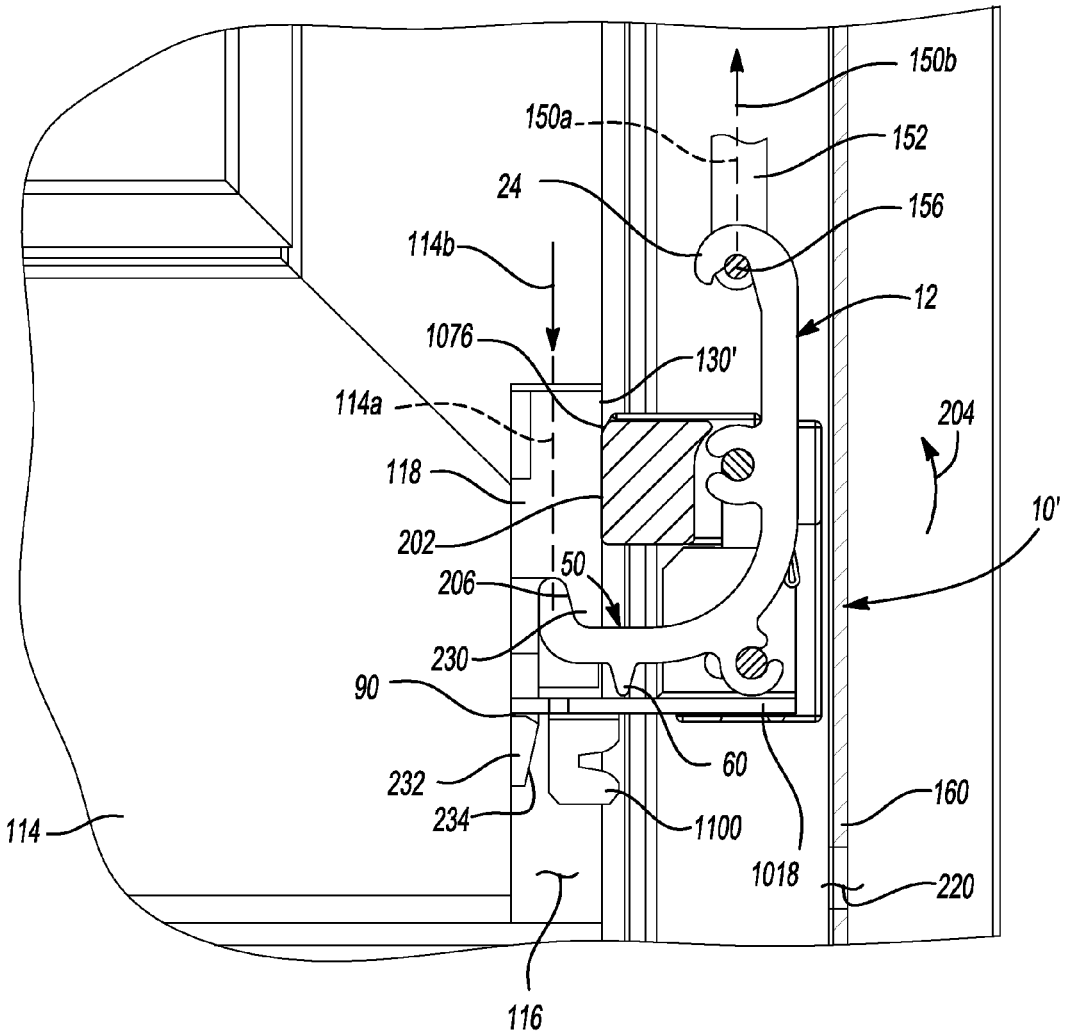
FIG. 11 is a partial cross-sectional front view of the environmental assembled view of FIG. 8.

The carrier assemblies 10, 10' as described above can be used to carry a window sash in a window assembly. The carrier assemblies 10, 10' can be used similarly, as described herein, to engage a window sash in a manner that minimizes the transfer of forces to the window jamb (e.g. forces that tend to urge the carrier into the wall of the jamb channel). Initially, the carrier assembly 10 is illustrated assembled in a window assembly in FIG. 7 and coupled to a window sash 110. The window sash 110 can be formed of a material to which a sash bracket 112 is connected. Appropriate window frame materials can include aluminum, fiberglass, extruded polymers, and the like. Generally, the window sash 110 may not include frame walls that are solid, but rather are extruded external walls with a hollow interior. As illustrated in FIG. 11, however, a window sash 114 can be formed with portions that are a substantially solid material (e.g. solid wood or fiberglass) where a depression 116 can be formed in a frame wall portion of the window sash 114 and a sash bracket 118 can be interconnected or positioned within the depression 116 in the window sash 114.

With initial the reference to FIG. 7, the interaction of the carrier assembly 10, the sash bracket 112, and the window sash 110 is illustrated and discussed. The window sash 110 can include a side wall 120 to which the sash bracket 112 is fixed. The sash bracket 112 can be fixed to the side wall 120 by one or more sash bracket fasteners including a first screw 122 and a second screw 124. Each of the screws 122, 124 can be fit to the sash bracket 112 and into the side wall 120 in a conventional manner. The sash bracket 112 can include a base portion or area 126 that is fit against and substantially flush with the wall 120 of the window sash 110. A projection portion 128 of the sash bracket 112 can include an abutment or carrier abutment wall or carrier engagement portion 130. The carrier engagement portion 130 can include a wall that extends between or from a first extension wall 132 and a second extension wall 133. The second extension wall 133 can engage the projection 56 of the carrier member 12. A cooperating hook projection or engagement member 140 can extend from the abutment wall 130 and below or beyond the extension wall 133. The cooperating projection 140 can engage at least a portion of the platform 50 of the carrier member 12. Additionally, the projection 56 of the carrier member 12 can engage a portion of the complimentary projection 140. The interaction of the projection 56 of the carrier member 12 and the complimentary projection 140 of the sash bracket 112, in combination with the interaction of the shoulders 76, 78 and the abutment surface 130, can hold the carrier assembly 10 at a single location relative to the sash bracket 112 during an operation of the a balance assembly 150.

The balance assembly 150 can include a balance arm or rod 152 that extends from a balance casing 154 to pass through the slot 26 in the carrier member 12. A projection or pin 156 can then be held in hook portions 24 of the carrier member 12. The pin 156 can be substantially perpendicular to a longitudinal axis of the balance assembly 150 generally defined along an axis 150*a*. In operation, the balance assembly 150 can be fixed to a wall 160 of the jamb portion with an appropriate fixation member 162, such as a rivet, screw, or other appropriate fixation member.

The latch member 18 can be rotated to a sash engagement position such that an end near the grip portion 98 engages a ledge or projection 170 extending from the sash bracket 112. The projection 170 can include a beveled or curved wall 172 that allows for engagement of the latch member 18 to the carrier member 12 and further includes a substantially planar wall extending generally perpendicular to the base plate 126 and generally parallel to the projection wall 132 to engage the latch member 18 in a substantially fixed manner to hold the latch member 18 to the sash bracket 112. The latch member 18 can provide at least some biasing of the carrier assembly 10 relative to the sash bracket 112 when a substantial force is not applied by the balance assembly 150. This can resist removal of the sash 110 from the carrier assembly 10 and minimize an undesired or unselected removal of the sash 110 from the jamb assembly. Additionally a biasing spring 180 can be provided to bias the latch member 18 toward the sash bracket 112 and generally on the engagement surface 174. Again, this can assist in holding the carrier assembly 10 to the latch bracket 112 when external forces are generally minimal or not being applied by the balance assembly 150.

The balance assembly 150 is fixed in the jamb wall 160 and when extended or providing a force to the carrier assembly 10 is, generally, providing a force along axis 150*a* and generally in the direction of arrow 150*b*. The weight of the sash 110 is generally along the axis 110*a* and in the direction of arrow 110*b* and carrier on the platform 50. The force from the balance assembly 150 in the direction of arrow 150*b* counteracts the weight of the sash 110. The counteracting forces between the sash 110 (generally in the direction of arrow 110*b*) and the balance assembly 150 (generally in the direction of arrow 150*b*) can maintain the sash 110 at a selected position. As is generally understood by one skilled in the art, the sash 110, however, may have a force due to gravity that is slightly larger than the counterbalance force of the balance assembly 150; however, other friction and torsional forces act to maintain the sash 110 in a selected position within the jamb when an external force, such as one by a user, is not applied. These maintaining forces are generally desirable, to a selected extent. It is excessive movement, such as twisting of the carrier assembly due to the balance spring that can create excessive forces. The carrier assembly, according to various embodiments as disclosed herein, contacts and engages a sash bracket and/or the sash can then resist or counteract forces on the carrier that would cause movement of the carrier. By resisting or eliminating movement of the carrier relative to the window sash additional undesired frictional forces can be reduced or eliminated.

With continuing reference to FIG. 7, and further reference to FIGS. 5 and 8, the axis 150*a* can be offset a distance 200 from the axis 110*a*. The axis 150*a* can be aligned with the axis 52*a* of the wall of the carrier 12, but is not required to be so. Because the opposing forces are offset by the distance 200 a moment is generated, exemplarily shown by arrow 204, relative to the carrier assembly 10, 10'. Generally, the moment 204 can urge the carrier assembly 10, 10' in the direction of arrow 204 forcing the respective shoulders 76, 78 or 1076 to engage the abutment 130 of the sash bracket 112 at an engagement interface 202 or shoulders 76, 78 to engage suitable elements of the window sash thereby reducing or eliminating movement or rotation of the carrier assembly 10, 10'

It will be understood that the moment 204 is created by the counteracting forces on the geometry of the carrier assembly 10, 10', the bracket assembly 112, and the jamb. Accordingly, the moment 204 also tends to urge the projection 56 away from the sash 110 and to contact and engage the cooperating hook 140 at the interface 206. The moment 204 caused by the balance assembly 150 and the weight of the sash 110 in the direction of arrows 150*b*, 110*b*, respectively, urges the carrier assembly 10, 10' against the sash bracket 112 that results in the interfaces 202 and 206 at the abutment 130 and the projection 140 on the sash bracket 112.

Generally, the side wall 120 of the sash 110 can be a side which assists in counter acting the forces from the carrier assembly 10, 10' and the balance assembly 150. The sash bracket 112 can be fixed to the side wall 120 to transfer forces to the sidewall and counteract those from the carrier assembly 10, 10' and balance assembly 150. A selected surface area of the shoulders 76, 78, 1076 is pushed against the sash bracket 112 to form a contact and engagement between the carrier assembly 10, 10' and the sash bracket 112. It can be understood that the projection 56 and the counter projection 140 can be provided to form a line or point of contact, but can also be understood to be substantially eliminated or a substantially small contact area relative to the size of the contact area between the shoulders 76, 78, 1076 and the abutment wall 130.

The forces between the carrier assembly 10 and the sash bracket 112 allow for a selected engaging connection of the carrier assembly 10, 10' relative to the sash bracket 112. By contacting and engaging the carrier assembly 10, 10' to the sash bracket 112, substantially all forces applied to the carrier assembly 10, 10' can be transferred directly to the sash 110 through the sash bracket 112 that is fixed to the sash 110. Due to the abutment of the shoulders 76, 78, 1076 with the abutment wall 130, a rotation of the carrier assembly 10, 10' relative to the sash bracket 112 can be substantially eliminated once contact of the shoulders 76, 78, 1076 have been made with the abutment wall 130. As also discussed above, the attachment lever 18, 1018 can assist in maintaining contact of the carrier assembly 10, 10' with the sash bracket 112 such that all additional forces simply act to further urge the carrier 10, 10' towards the sash bracket 112 and reinforce the initial contact.

Additionally, the forces applied by the balance assembly 150 that are substantially not in the direction of arrow 150*b* can also be transferred substantially directly to the sash bracket 112 via the shoulders 76, 78, 1076. As discussed above, the balance assembly 150 can include a torsion spring. The torsion spring applies a reaction force to the balance bar 152 and the carrier assembly 10, 10'. The torque force or moment, as illustrated in FIG. 5, can generally be in the direction of arrow 152*a* around the axis 150*a* of the balance assembly 150. The moment 152*a* will further tend to urge the carrier assembly 10, 10' against the sash bracket 112 at the shoulders 76, 78, 1076. The rotation is further countered by the interaction of the projection 56 of the carrier member 12 and the counter projection 140 of the sash bracket 112. These two areas of contact resist the rotation of the carrier assembly 10, 10' due to the moment 152*a*. Thus, the carrier assembly 10, 10' contacts and engages the sash bracket 112 such that the carrier assembly 10, 10' is substantially immobile and is not allowed to rotate.

In further operation, such as during assembly or removal of the sash 110 from the carrier assembly 10, the latch member 18 can be operated to disengage from the projection 170 and rotate toward the jamb wall 160 such that one or more of the projections 100, 102 pass through an opening 220 in the jamb wall 160. The force of the balance assembly 150 can then hold the carrier assembly 10 relative to the passage 220 and the projection 100 with the jamb wall 160. The sash 110 can then be lifted from the projection 56 due to the disengagement of the latch member 18 from the projection 170. As the sash 110 is removed, the force in the direction of arrow 150*b* is counteracted by the projection 100 through the jamb wall 160. The sash 110 can then be lifted from the projection 56 and removed from the window assembly in a generally understood side, or rack, loading or unloading operation. It will also be understood that the assembly of the balance assembly 150 within the window frame can also be performed in a substantially similar manner by fixing the balance assembly 150 to the jamb, as discussed above, and pulling the balance rod 152 to engage the hook portions 24 of the carrier member 12 while the projection 100 is positioned through the passage 220 in the jamb wall 160. The window sash 110 can then be loaded onto the projection 56 in a generally understood side, or rack, loading operation.

As briefly discussed above, and with further reference to FIGS. 8-10, the carrier assembly 10' is illustrated as being coupled to the balance assembly 150 and the sash bracket 112. As discussed above, the sash bracket 112 can be fixed to the sash 110 with appropriate fasteners, such as the screws 122, 124. When the latch member 1018 is engaging the sash bracket 112 then the balance assembly 150, which is coupled to the carrier assembly 10' via the rod 152, can apply a force in the direction of arrow 150*b* along axis 150*a*. The sash 110, counter to the balance force, applies a force in the direction of arrow 110*b* generally along the axis 110*a*. As discussed above, the offset distance 200 of the position of the two force axes 110*a*, 150*a* causes the moment 204 relative to the carrier assembly 10'. Generally, the offset distance 200 causes the portion of the carrier assembly 10' nearest the balance assembly 150 to be urged in the direction of arrow 204 towards the sash bracket 112 and the portion near the platform 50 to be urged away from the sash bracket 112. Thus, due to the offset distance 200 of the forces 110*b*, 150*b* the carrier assembly 10' contacts and engages the sash bracket 118 reducing or eliminating undesired forces within the jamb.

The latch member 1018 can also be moved to have the projection 1110 pass through the passage 220 to engage the jamb wall 160. This fixes the carrier assembly 10' in a position relative to the jamb wall 160. As discussed above, this can allow the sash 110 to be removed from the carrier assembly 10' or installed onto the carrier assembly 10' while the carrier assembly 10' is held in a single location.

According to various embodiments, the carrier assembly 10' can be interconnected with other window sash assemblies other than those discussed above, but operate in a substantially similar manner. For example, with reference to FIG. 11, the carrier assembly 10' can be interconnected with the window sash 114 that can be formed of a solid material, including wood, and having the sash bracket 118. The sash bracket 118 can be fixed within the depression 116 formed in the solid material of the window sash 114. The sash bracket 118 can include portions that are substantially similar to the portions of the sash bracket 112 discussed above. For example, the sash bracket 118 can include a counter projection 230 that is similar to the counter projection 140 of the sash bracket 112. The sash bracket 118 can also include a projection 232 that includes a beveled wall 234 to engage the attachment lever 1018. As discussed above, the projections 100, 102 of the attachment lever 1018 can be positioned in the passage 220 of the jamb wall 160. The sash bracket 118 can be provided as a single member or multiple pieces that are fixed into the depression 116. It will be further understood, however, that even the window sash 114 formed of a solid material need not include a formed depression, but can include a sash bracket such as the sash bracket 112.

Nevertheless, the interaction of the carrier assembly 10' with the sash bracket 118 can be substantially similar as discussed above. That being the case, generally, the balance assembly can provide a force in the direction of arrow 150*b* and the window sash 114 can provide a force generally in the direction of arrow 114*b*. Again, the axes 150*a*, 114*a* of the two forces 150*b*, 114*b*, respectively, can be offset from one another to form moment 204. Due to the moment 204 the shoulder 1076 of the encasement 1014 generally is urged towards the sash bracket 118 and to engage a sash bracket wall 240 while the projection 56 is urged against the counter projection 230 of the sash bracket 118 to form the interface 206. As discussed above, the moment 204 can substantially load the forces from the carrier assembly 10' due to the balance assembly 150 toward a side of the sash 114 to contact and engage the carrier assembly 10' with the window sash 114. When so engaged, the carrier assembly 10' is generally immobile relative to the sash bracket 118. Further, the latch 1018 can engage the sash bracket 118, as discussed above in relation to the sash bracket 112.

Figure 12:
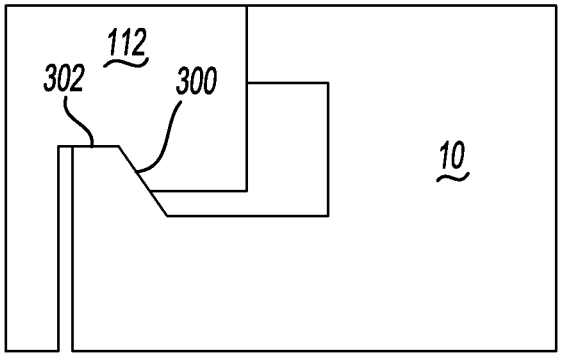
FIG. 12 is a schematic view showing a contact between a carrier assembly and a window sash assembly according to the disclosure.
Figure 13:
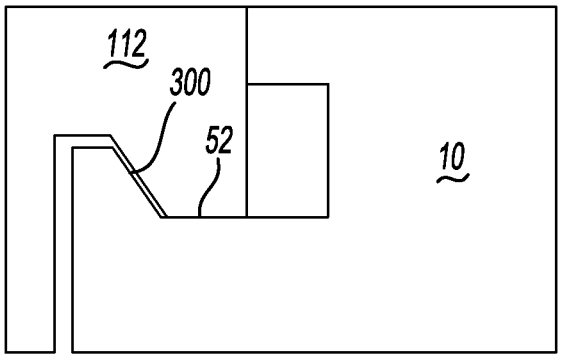
FIG. 13 is a schematic view showing an alternative contact between a carrier assembly and a window sash assembly according to the disclosure.
Figure 14:
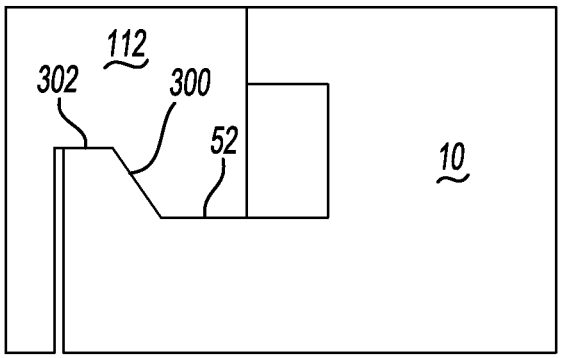
FIG. 14 is a schematic view showing another alternative contact between a carrier assembly and a window sash assembly according to the disclosure.

According to various embodiments, there are several mechanisms and configurations in which the weight of the sash 110, 114 may be supported by the carrier assembly 10. As discussed above the carrier assembly 10 includes the platform 50 and the projection 56. These portions of the carrier assembly 10 can be configured to engage the sash bracket 112 according to various embodiments. For example, FIG. 12 illustrates a slanted surface 300 (e.g. a portion extending from the surface 52 to the projection 56) and an end surface 302 (e.g. a portion of the projection 56), where the weight can be supported by these two surface. Further examples, such as in FIG. 13 illustrates the weight being supported by contact of the sash bracket 112 with the slanted portion 300 and the platform surface 52 of the carrier assembly 10. Yet a further example is illustrated in FIG. 14 where the weight of the sash is supported by the sash bracket in contact with the slanted portion 300, the end portion 302, and the platform surface 52 of the carrier assembly.

Figure 15:
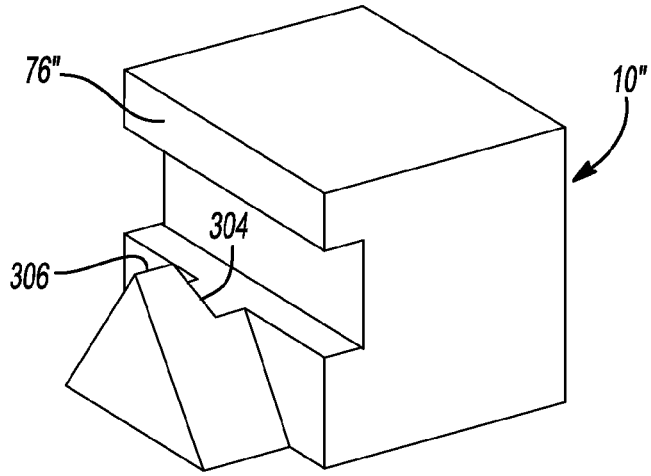
FIG. 15 is a schematic perspective view of a carrier assembly component, which supports the weight of a sash assembly according to the disclosure.
Figure 16:
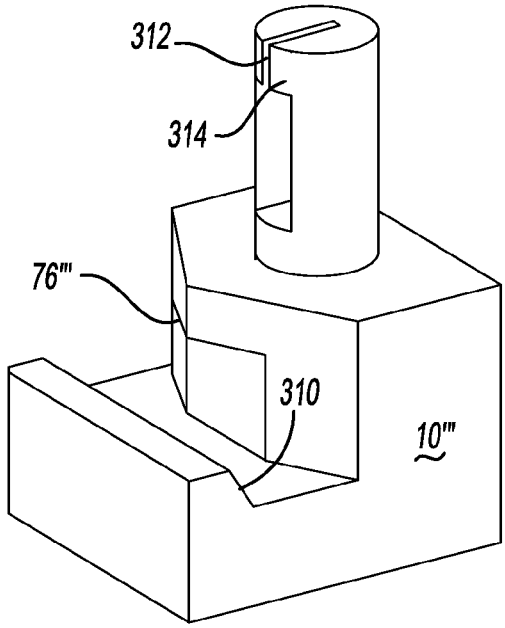
FIG. 16 is a schematic perspective view of a carrier assembly component, according to the disclosure.

According to various embodiments, non-linear contact points between a carrier assembly and a sash bracket or sash wall can be created. The non-linear points of contact can establish a non-sliding contact between the carrier assembly and the sash bracket. The non-linear points generally define a plane of contact. For example, as illustrated in FIG. 15, a carrier assembly 10" includes a shoulder portion 76" that forms a line of contact with the sash bracket 112 to support a portion of the weight of the sash 110, 114. The carrier assembly 10" includes a wedge-like portion 304 that can terminate substantially in a line 306 for supporting a portion of the weight of the sash. In some embodiments, as illustrated in FIG. 16, a carrier assembly 10''' has an area of contact between a wedge-like portion 310 and at least one shoulder portion 76''' and the sash bracket to prevent the carrier assembly from twisting relative to the jamb channel. The shoulder 76''' can form substantially a single point or line of contact with the sash bracket. Also, the carrier assembly 10''' can include an upper portion that is generally cylindrical in shape and having a slot 312 in the top and flanking portions 314 for non-permanently coupling the balance system 150 to the carrier assembly 10'''.

Figure 17:
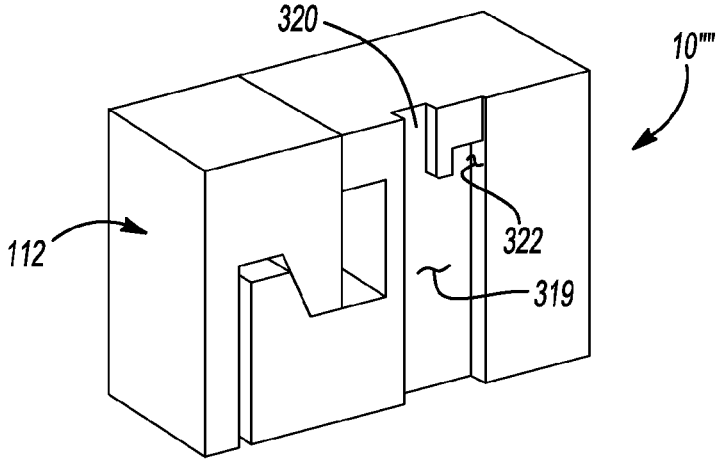
FIG. 17 is a schematic perspective cross-sectional view of a carrier assembly component with an internal balance coupling structure according to the disclosure.

As illustrated in FIG. 17 the balance assembly 150 is coupled to a carrier assembly 10'''' in an internal space 319 of the carrier assembly 10''''. The end of the balance rod 152 is maintained in a slot 320 in the carrier assembly 10'''' by flanking portions 322 of the carrier assembly 10''''. Although several means for coupling a balance to a carrier have been described herein, any method or means for securely, but not permanently, coupling the balance 150 to the carrier assembly may be used.

Figure 18:
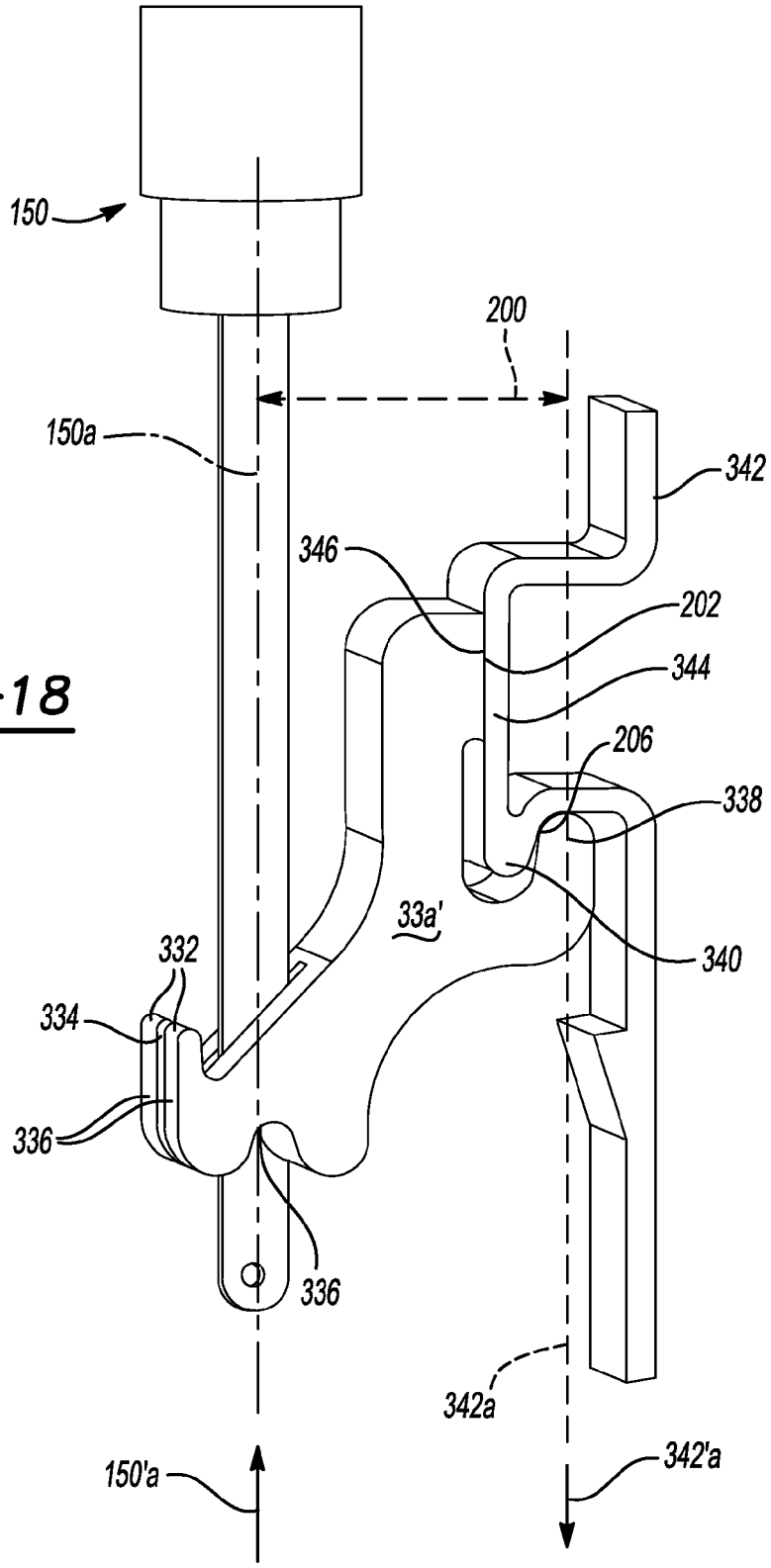
FIG. 18 is a perspective view of a balance, a carrier, and a sash bracket according to another embodiment of the disclosure.
Figure 5:
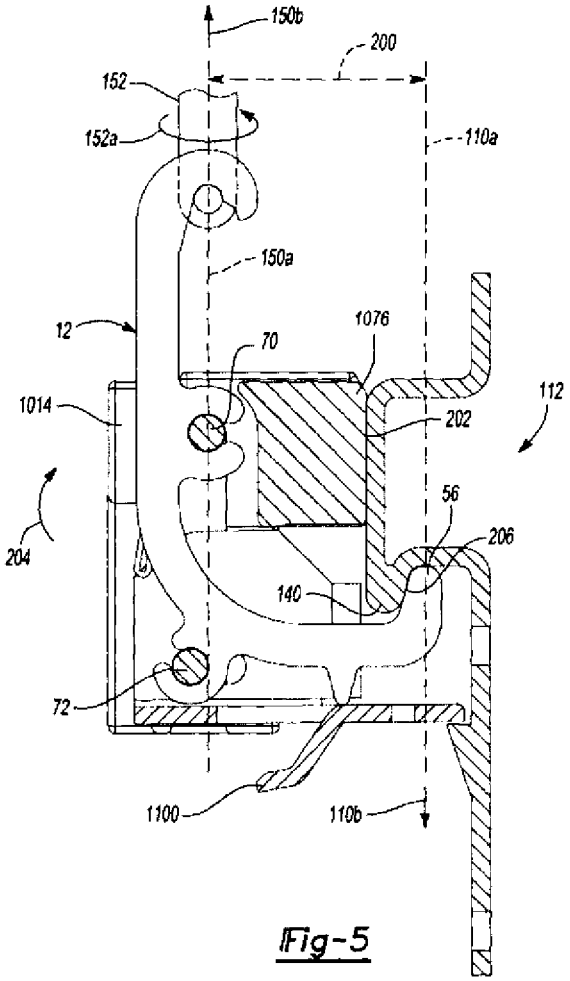
Figure 6:
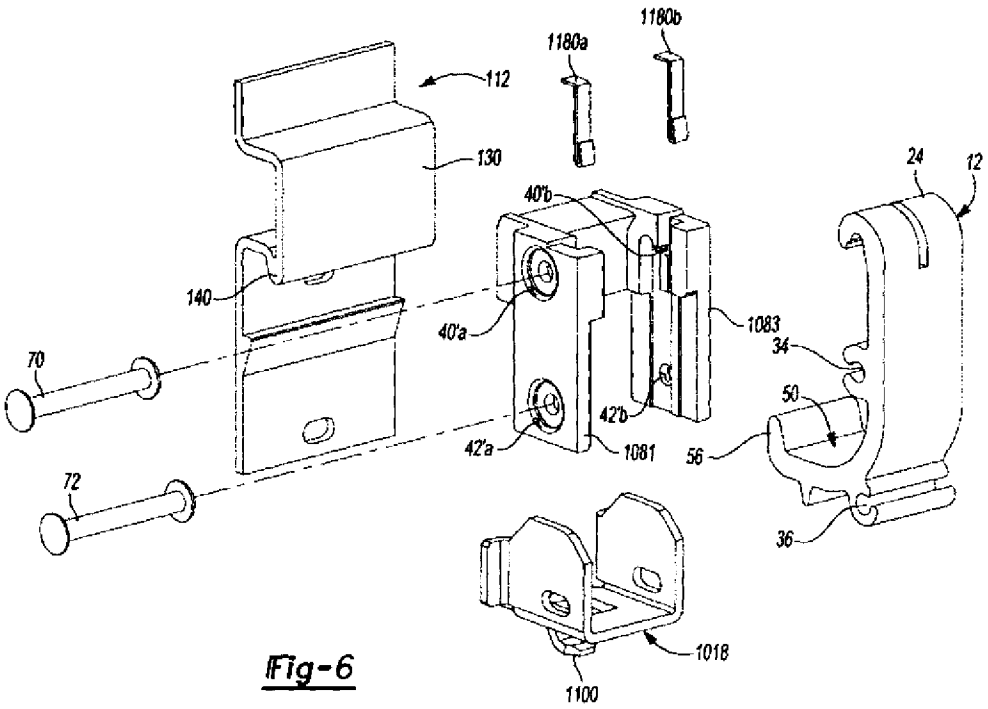

FIGS. 1-17 illustrate carrier assemblies where the balance coupling portion is located vertically higher than the sash assembly coupling portion in the assembled counterbalance system. FIG. 18 illustrates an alternative carrier assembly 330 and sash bracket 342. In the alternative carrier assembly 330, a balance coupling portion may alternatively be located in vertical alignment with the sash assembly coupling portion or vertically lower than the sash assembly coupling portion. Further, as illustrated in FIG. 18, the carrier assembly can be formed as a single piece with no additional encasement members.

With continuing reference to FIG. 18, the carrier assembly 330 can include a hook portion 332 with a slot 334 at a lower portion of the carrier assembly 330. The balance assembly 150 is inserted into the slot 334 and reversibly coupled to the hook portion 332 by a pin or member 336. An upstanding ledge 338 in a middle section of the carrier assembly 330 can non-permanently, but securely engage a complementary hook extension 340 of the sash bracket 342 that can be attached to a window sash to carry a weight of the window sash. The carrier assembly includes a shoulder portion 344 that applies a side load to the carrier assembly contacting portion 346 of the sash bracket 342 as a result of the offset between the lifting load force along axis 150*a* in the direction of arrow 150*a*' and load forces (e.g. weight of the window sash) along axis 342*a* in the direction of 342*a*'. As discussed, above, the offset distance 200 between the two axes 150*a* and 342*a* generates a moment on the carrier assembly 330 that causes contact and engagement between the carrier assembly 330 and the sash bracket 342. The contact between the carrier assembly 330 and the sash bracket 342 at the interfaces 202, 206 generally hold the carrier assembly 330 immobile relative to the sash bracket 342. Further, as illustrated in FIG. 18, the shoulder portion 344 is part of the carrier assembly 330 and no encasement member is needed. Also, a sliding bearing surface 336 extending from near the hooks 332 can engage the jamb wall 160, as discussed above, to assist in horizontally locating the window sash.

In view of the foregoing description, it should be appreciated that in some embodiments, the carrier assembly, the carrier latch, the fasteners, the biasing spring, and the sash bracket are made of a metal and the encasement member is made of plastic. In some embodiments, the metal is aluminum. In other embodiments the carrier and the encasement member are formed of plastic as a single integral component.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A window carrier system coupled to a balance assembly for use in carrying a window sash assembly, the carrier system comprising:

a carrier assembly including:

a balance assembly coupling portion configured to couple to the balance assembly, a window sash assembly carrying portion configured to carry and sustain a weight of the window sash assembly, and a window sash assembly contacting portion configured to contact the window sash assembly;

wherein the window sash assembly carrying portion is offset a distance from the balance assembly coupling portion, wherein the balance assembly pulls the carrier assembly along a line of pull extending from the balance assembly coupling portion;

wherein the window sash assembly contacting portion engages the window sash assembly when the balance assembly exerts a force on the carrier assembly to counter the weight of the window sash due at least in part to a moment created by the weight force of the window sash being applied to the window sash assembly coupling portion which is offset from the balance assembly coupling portion where a counter force from the balance assembly is generated.

2. The window carrier system of claim 1, wherein the carrier assembly contacts the window sash assembly at a minimum of three non-linear points to form a plane of contact.

3. The window carrier system of claim 1 further comprising:

a carrier encasement member to at least partially encase a carrier member of the carrier assembly, the carrier encasement member having at least one shoulder;

wherein all of the balance assembly coupling portion and the window sash assembly carrying portion are defined by a carrier member and the carrier encasement member is coupled to the carrier member;

wherein the at least one shoulder defines the window sash assembly contacting portion.

4. The window carrier system of claim 1 further comprising:

a carrier latch comprising at least one protrusion where the protrusion is insertable into a slot in a window frame to non-permanently hold the carrier assembly at a predetermined vertical location along the window frame.

5. The window carrier system of claim 4, wherein the window sash assembly comprises a latch engagement element and wherein an end of the carrier latch is engageable with the latch engagement element when the protrusion is not inserted into the slot of the window frame.

6. The window carrier system of claim 1, wherein the window sash assembly comprises a carrier holding portion operable to carry the window sash assembly on the window sash assembly carrying portion of the carrier assembly.

7. The window carrier system of claim 6, wherein the window sash assembly carrying portion has an edge that forms a line of contact with the window sash assembly perpendicular to the side of the window sash assembly to support a portion of the weight of the window sash assembly.

8. A window carrier system coupled to a window balance assembly for use in carrying a window sash assembly, the carrier system comprising:

a carrier assembly having:

a carrier member with a window balance assembly connection portion formed at a first region of the carrier member to connect to the window balance assembly and a window sash assembly connection portion formed at a second region of the carrier member to connect to the window sash assembly wherein the first region is offset a transverse distance apart from the second region, wherein the transverse distance is measured transverse to a line along which a pulling force of the window balance assembly is applied, and a window sash assembly contacting portion to contact the window sash assembly; and a window sash assembly connection member configured to engage the window sash assembly connection portion, wherein the window sash assembly connection member has a first carrier member engaging portion and a second carrier member engaging portion;

wherein the carrier member selectively engages the window sash assembly connection member at both the first carrier member engaging portion and the second carrier member engaging portion when a force is acting on the carrier assembly due to the offset transverse distance where a weight of the window sash assembly is countered by the pulling force of the window balance assembly such that the carrier assembly is urged towards the window sash assembly and contacts the window sash assembly connection member with the window sash assembly contacting portion.

9. The window carrier system of claim 8, wherein at least one of the first carrier member engaging portion or the second carrier member engaging portion is substantially flat.

10. The window carrier system of claim 9, wherein the carrier assembly further comprises:

a jamb engaging latch pivotally coupled to the carrier member;

wherein the jamb engaging latch is operable to engage a jamb wall along which the carrier member is operable to move.

11. The window carrier system of claim 10, wherein the window sash assembly connection portion includes a platform and an upstanding ledge that extends from the platform;

wherein the upstanding ledge has a ledge surface extending at a non-zero angle relative to the platform to positively engage and form an interface with the window sash assembly connection member.

12. The window carrier system of claim 8, wherein the carrier assembly further comprises:

at least one encasement member coupled to the carrier member, wherein the encasement member has at least one shoulder that defines the window sash assembly contacting portion.

13. The window carrier system of claim 12, wherein the at least one encasement member includes a first encasement member and a second encasement member, wherein the at least one shoulder includes a first shoulder and a second shoulder;

wherein the first encasement member has the first shoulder and the second encasement member has the second shoulder;

wherein the first shoulder and the second shoulder cooperate to define the window sash assembly contacting portion.

14. The window carrier system of claim 8, wherein the first region is offset a vertical distance apart from the second region, wherein the vertical distance is measured along a line substantially parallel to the line along which the pulling force of the window balance assembly is applied.

15. The window carrier system of claim 8, wherein the window sash assembly contacting portion is defined by the carrier member.

16. The window carrier system of claim 8, wherein the window sash assembly connection portion and the window sash assembly contacting portion define at least three non-linear points of contact with the window sash assembly connection member.

17. A window carrier system coupled to a window balance assembly for use in carrying a window sash assembly, the carrier system comprising:

a carrying assembly having:

a carrier member that has at least a balance connection portion to connect to the window balance assembly and a carrying portion positioned an offset distance from the balance connection portion to carry the window sash assembly, wherein the offset distance is measured transverse to a line along which a pulling forceof the window balance assembly is applied to the carrier member, a window sash contacting portion that is positioned between the balance connection portion and the carrying portion, and a latch member pivotally coupled to the carrier member; and a sash connection member to removably engage at least the carrying portion and window sash contacting portion, wherein the carrying portion includes a platform extending from a wall of the carrier member to allow the window sash assembly to be carried by the platform;

wherein when the window sash assembly is carried on the platform a sash weight is applied to the carrier member and a balance force from the window balance assembly at least partially balances the sash weight and generate a moment relative to the carrier member due to the offset distance, wherein the moment causes the window sash contacting portion to be urged towards the sash connection member.

18. The window carrier system of claim 17, wherein the offset distance is along a line that is transverse to a longitudinal axis of the carrier member, wherein the carrier member is urged to rotate towards the sash connection portion.

19. The window carrier system of claim 18, wherein the window balance assembly has a balance rod connected to the balance connection portion to apply the balancing force to the carrier member.

20. The window carrier system of claim 17, further comprising:

a grip portion extending from a surface of the latch member;

wherein the grip portion is operable to assist in rotation of the latch member.

21. The window carrier system of claim 17, further comprising:

an upstanding ledge that extends from the platform;

wherein the upstanding ledge has a ledge surface extending at a non-zero angle relative to the platform to positively engage and form an interface with the window sash assembly connection member.

22. The window carrier system of claim 17, wherein the carrier assembly further comprises:

at least one encasement member coupled to the carrier member, wherein the encasement member has at least one shoulder that defines the window sash assembly contacting portion.

23. The window carrier system of claim 22, wherein the at least one encasement member includes a first encasement member and a second encasement member, wherein the at least one shoulder includes a first shoulder and a second shoulder;

wherein the first encasement member has the first shoulder and the second encasement member has the second shoulder;

wherein the first shoulder and the second shoulder cooperate to define the window sash assembly contacting portion.

24. The window carrier system of claim 17, wherein the balance connection portion is offset a vertical distance apart from the carrying portion, wherein the vertical distance is measured along a line substantially parallel to the line along which the pulling force of the window balance assembly is applied.

25. The window carrier system of claim 17, wherein the window sash contacting portion is defined by the carrier member.

* * * * *

UNITED STATES PATENT AND TRADEMARK OFFICE

CERTIFICATE OF CORRECTION

PATENT NO. : 8,448,296 B2
APPLICATION NO. : 13/273700
DATED : May 28, 2013
INVENTOR(S) : Wilbur James Kellum, III It is certified that error appears in the above-identified patent and that said Letters Patent is hereby corrected as shown below:

In the Claims:

In Col. 16, Line 25, Claim 17, replace "forceof" with -- force of --.

Signed and Sealed this
Twenty-third Day of July, 2013

Teresa Stanek Rea
*Acting Director of the United States Patent and Trademark Office*

UNITED STATES PATENT AND TRADEMARK OFFICE

CERTIFICATE OF CORRECTION

PATENT NO. : 8,448,296 B2
APPLICATION NO. : 13/273700
DATED : May 28, 2013
INVENTOR(S) : Wilbur James Kellum, III It is certified that error appears in the above-identified patent and that said Letters Patent is hereby corrected as shown below:

In the Drawings

Sheet 4 of 12, Figure 5, delete "1070" and insert --1076--. The correct Figure is attached herewith. Please replace Figure 5 with the attached Figure 5.

Sheet 5 of 12, Figure 6, delete "1083". The correct Figure is attached herewith. Please replace Figure 6 with the attached Figure 6.

In the Claims

In Col. 14, Lines 28-29, Claim 1, the phrase "window sash assembly coupling portion" should be replaced with --window sash assembly carrying portion--.

Signed and Sealed this
Thirtieth Day of June, 2015

Michelle K. Lee

Michelle K. Lee
*Director of the United States Patent and Trademark Office*